United States Patent [19]

Wang

[11] Patent Number: 4,969,868

[45] Date of Patent: Nov. 13, 1990

[54] MICROELECTRIC IONIZED DEVICE FOR CURING ORAL CAVITY DISEASES

[76] Inventor: Ling Wang, WangLing Laboratory Zhuangyuan Qiao, Wenzhou, Zhejiang Province,, China

[21] Appl. No.: 315,653

[22] Filed: Feb. 27, 1989

[30] Foreign Application Priority Data

Mar. 9, 1987 [CN] China ..... 87101867

[51] Int. Cl.[5] ..... A61N 1/30

[52] U.S. Cl. ..... 604/20; 128/393; 128/787; 15/167.1; 433/216

[58] Field of Search ..... 128/393, 639, 642, 784, 128/787, 801; 604/20; 433/32, 216; 15/167.1

[56] References Cited

U.S. PATENT DOCUMENTS 3,478,741 11/1969 Simor ..... 604/20

4,483,848 11/1984 Cox et al. ..... 424/49

4,665,921 5/1987 Teranishi et al. ..... 604/20

*Primary Examiner*—Randall L. Green

*Assistant Examiner*—Randy Shay

*Attorney, Agent, or Firm*—Armstrong, Nikaido, Marmelstein, Kubovcik & Murray

[57] ABSTRACT

A microelectronic ionized device for curing oral cavity diseases being a special kind of toothbrush comprising a brush head, brush handle and a cavity in the handle for retaining a battery. A group of special bristles serving as a cathode at the brush head is connected in series with the battery and a metal plate which serves as an anode adjacent the brush head. During toothbrushing, saliva and/or ionized toothpaste fills the space between the cathode and anode to form a return circuit. When this occurs the trace elements in the special bristle releases ions essential for cementosis while at the same time produces a microcurrent to stimulate such soft tissues as the oral cavity and gums, thus achieving an effect of physical massage. Consequently, various kinds of diseases of the oral cavity are cured. The use of ionized toothpaste enhances the curing effect.

16 Claims, 1 Drawing Sheet

MICROELECTRIC IONIZED DEVICE FOR CURING ORAL CAVITY DISEASES

This application is a continuation-in-part of prior U.S. Pat. application No. 165,331, filed Mar. 8, 1988, and now abandoned.

BACKGROUND OF THE INVENTION

The present invention relates to a household microelectronic device which makes use of ions to cure various kinds of oral cavity diseases, and more particularly, it relates to the microelectronic device in the form of a toothbrush.

With a view to providing solutions to the three major problems in world stomatology, i.e., tooth decay, disease of the oral mucous membrane and cementoclasia, Jiro Kiriyama, a Japanese authority in stomatology, had suggested an assumption and theoretical foundation for curing and preventing tooth decay and encouraging cementosis by means of ions. However, until now there has not been any effective device which could put his idea into practice. According to the statistics of the World Health Organization, over 90% of the people in the world are suffering from tooth decay to varying degrees. The breadth of stomatologic and dental disease is shockingly vast.

An object of this invention is to provide a household microelectronic device for solving the three major stomatologic problems in the world such that with the device as a household therapeutic instrument, dental therapy requiring surgery could be avoided.

SUMMARY OF THE INVENTION

A preferred embodiment of the invention is a device for treating oral cavity diseases comprising resilient conductive apparatus for contacting the teeth, an exposed conductor adjacent but not contacting the resilient conductive apparatus for disposition within the oral cavity, apparatus for connecting the negative pole of a battery to the resilient conductive apparatus and the positive pole of a battery to the exposed conductor, the resilient conductive apparatus including a group of trace elements releasing ions into the oral cavity upon conduction of current between the resilient conductive apparatus and the exposed conductor within the oral cavity.

Another embodiment of the invention is a toothbrush device for treating oral cavity diseases having a handle and a head comprising a cavity in the handle for retaining a battery, toothbrush bristles retained by the head for cleaning the teeth, a cathode lead wire for connection to the negative pole of the battery, an exposed conductive anode adjacent to the brush head for connection to the positive pole of the battery, first (or special) conductive bristles retained by the brush head serving as a cathode, the first conductive bristles being comprised of a composite tungsten-boron fibre material and including a group of trace elements releasing ions, the first conductive bristles being connected to the cathode lead wire for connection to the negative pole of the battery.

The position of the cathode lead wire and anode are reversible and the reversal can be attained by just placing battery 12 in the position opposite to that as illustrated in FIGS. 1 and 2. Under such circumstances, said device will only be suitable for curing very rare oral cavity or dental diseases and it must be used together with ionized toothpaste containing iodine instead of fluoride.

BRIEF DESCRIPTION OF THE DRAWINGS

A better understanding of the present invention will be obtained by reference to the description below, and to the drawings in which.

DETAILED DESCRIPTION

Figure 1:
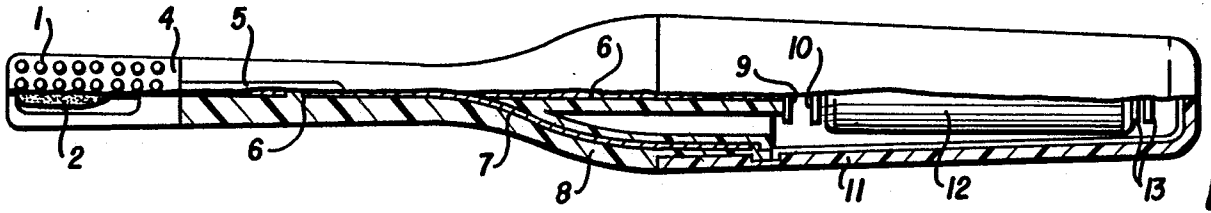
FIG. 1 is a partly cut-away top and side view of the present invention.
Figure 2:
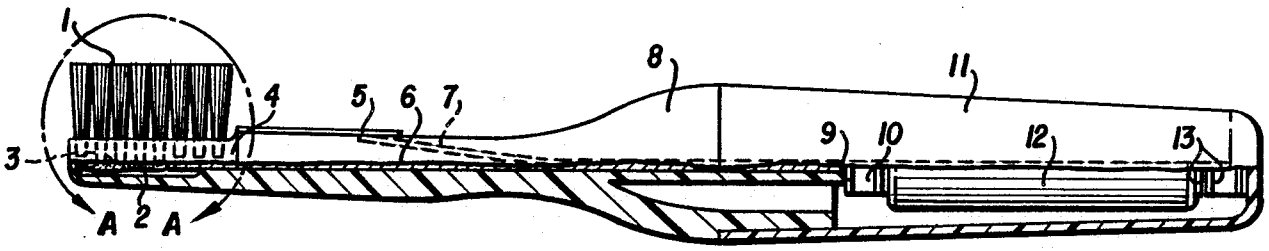
FIG. 2 is a partly cut-away side view of the present invention.

The preferred form of the microelectronic ionized device of this invention for curing oral cavity diseases is a special kind of toothbrush comprising a cavity battery container 11 provided with a replaceable battery 12, a brush handle 8 fixed to the battery container, a brush head 4 retaining ordinary bristle fixed to the brush handle, a cathode lead wire 6 connected to the negative pole of the battery and an anode 5 adjacent to the brush head and connected to the positive pole of the battery. The brush head is also provided with and retains special bristles serving as the cathode which is connected to the cathode lead wire. The special bristles are made of a composite tungsten-boron fibre material with a nylon base and comprised of a group of trace elements releasing ions and is preferably affixed in the middle of the ordinary bristle.

The special bristle is firmly stuck to the brush head 4 with nylon base binder 3 and to cathode lead wire 6 in brush handle 8 with conductive binder 2. Spring plate 10 which is soldered or welded to a welding point 9 at the other end of the lead wire is in contact with the negative pole of battery 12. Anode 5 is fixed to the exposed part of the brush handle adjacent to the brush head and is connected to anode lead wire 7. Anode spring plate 13 is affixed in the battery box and is in contact with the positive pole of the battery, and is in contact with anode lead wire 7.

Figure 3:
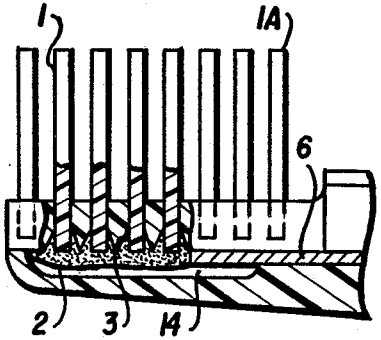
FIG. 3 is an enlargement of the head of the toothbrush included in circle A of FIG. 2.

Referring now to FIG. 3, a detail of the preferred structure of the head of the toothbrush is shown. The conductive bristles 1, which are shown cross-hatched, penetrate through the part of the brush head above the conductor 6 into a cavity 14 in which the end of conductor 6 also penetrates. Ordinary bristles 1A are retained by the brush head in a well known manner, and do not penetrate into the cavity. The conductive binder 2 surrounds the bottom portion of the conductive bristles 1 and the end of wire 6, so that an electrical conductive circuit will exist between the wire 6 and conductive bristles 1.

The conductive bristle is formed of composite tungsten-boron fibre material covered with a layer of nylon. It is preferably manufactured by means of gas-phase deposition of pure boron from a halide such as boron chloride reduced in a hydrogen medium on a tungsten filament. The resulting structure is then covered with a layer of nylon fibre. During the time that the gas of hydrogen-containing boron chloride surrounds the tungsten filament, halides such as the chloride of the trace elements molybdenum, cobalt, vanadium, beryllium, platinum and rhenium are reduced by blending their halides in the gas of hydrogen containing the boron chloride.

The gas phase reduction of boron is performed at between 1,200°C. and 1,300°C., the temperature of the tungsten filament preferably being at 1,240°C.±5°C. The tungsten filament is heated preferably by high frequency current, or alternatively by low voltage direct current or other suitable electric power.

The amount of each of trace elements added should be approximately $10^{-12}\times 10$ grams relative to one gram of pure boron.

The diameter of the tungsten filament should be sufficiently thin that it is not stiff and thus still not damage the gums of the user. Its diameter is preferably between 1.25 mg/200 mm and 1.35 mg/200 mm. The content of the boron is preferably about 14% of the tungsten-boron fibre by weight. The diameter of the tungsten-boron-nylon bristle fibre can be from 0.20 mm to 0.25 mm, the preferably diameter being 0.20 mm.

It is preferred that the conductive binder should be formed of about 30–45% by weight of activated carbon, 5–20% by weight of silver oxide. A binder for the above should be made of material identical to or similar to the material of the brush handle, such as A.B.S. The weight ratio should be 50–70%, preferably about 62%.

When the toothbrush is not used and is dry, it is in the state of an open circuit, but when the toothbrush is being used to brush the teeth, saliva and/or ionized toothpaste spread on the brush head or the foam from the toothpaste fills the space between the special bristles 1 serving as a cathode and anode 5 to form a complete circuit to the battery. In this circumstance a group of trace elements in the special bristle releases ions needed for cementosis, under the action of the current and voltage, on one hand, and on the other hand produces a micro-current to stimulate the soft tissues in the oral cavity and gums so as to encourage blood circulation, regulate the nerve endings and improve the soft tissues, that is, to achieve an effect of physical massage. The application of ionized toothpaste greatly improves the therapeutic effect due to the fact that the ions thereof are guided into the tooth enamel.

It may be understood that saliva or the ionized toothpaste has the function of being an automatic on-off switch. The voltage of the battery can be 1.5v–4.5v according to the degree of sensitivity of the oral cavity of various individuals. The device of the present invention can be used independently to prevent diseases of the oral cavity. However, when it is used to cure oral cavity diseases, it should be used together with the ionized toothpaste.

In using the device, a daily hygienic habit of tooth brushing can be taken advantage of by people to cure themselves without spending any extra time and energy. With the device it has been found that diseases like dentinalzia, sensitive dentin or glossitis can be cured within 10–20 seconds.

EXAMPLE 1

A method for preparing the conductive binder and preferred portions thereof is as follows. A small amount of oleic acid is added to a mixture of 40% by weight of activated carbon and 10% by weight of silver oxide and they are perfectly blended. An equal amount by weight of binder such as A.B.S. is heated in a container to 125°C. -145°C., and stirred at the temperature while the mixture is added. The stirring is continued until the resulting mixture is homogeneous. Then the mixture is squeezed into particles or smashed into a powder for future use. It is preferable that the binder should be applied at between 125°C. and 145°C., preferably at 145°C.

EXAMPLE 2

A binder such as A.B.S. is dissolved in a solvent such as methylbenzene. 45% by weight of activated carbon and 5% by weight of silver oxide with a granularity of over 200 mesh is added and then stirred until they are well distributed. Then the mixture is placed in a sealed container for a period of time, e.g., 24 hours. The resulting binder can be used at normal temperature.

EXAMPLE 3

A preferred form of ionized toothpaste can be manufactured as follows. 5000 c.c. of pure water and 680 grams of pure white sugar and 26 grams of sodium fluoride are placed into a container and stirred at 21°C. until the sodium fluoride and pure white sugar are completely dissolved. 1,500 c.c. of glycerol is then placed into the container at the original temperature, e.g., 21°C., while the above mixture is stirred continuously. When everything is well distributed, 750 grams of sodium dodecanol sulphate is added while the mixture is being stirred until the newly added material is completely dissolved. The mixture then should be allowed to sit for about 24 hours.

Following this, 200 grams of methyl cellulose is added at the original temperature, e.g., 21°C., while the mixture is stirred until complete dissolution. A flavouring essence comprised of 30 cc of mint and 50 cc of tangerine is added at the same temperature, while the mixture is continuously stirred. Following this, other components of normal toothpaste, e.g., an abrasive agent such as aluminum oxide, silicon dioxide or precipitated calcium carbonate, should be put into the above-described mixture while it is being stirred. This completes the process of manufacturing the toothpaste by means of an ordinary apparatus for ordinary toothpaste.

It should be noted that the proportions of the materials used for the given amount of water is variable. For example, between about 680–1,200 grams of pure white sugar can be used, between about 750–950 grams of sodium dodecanol sulphate can be used, between about 200–310 grams of methyl cellulose can be used, between about 25–200 grams of sodium fluoride can be used, between about 1,500 cc–3,000 cc of glycerol can be used, between about 30–65 cc of mint essence can be used and between about 50–100 cc of tangerine essence can be used. The above proportions can be scaled up or down to match the amount of pure water in each batch.

The sodium dodecanol sulphate functions as a froth-generator and cleaner for the toothpaste. Methyl cellulose acts as its excipient, glycerol as its pain killer and water-retainer in the paste, while sodium fluoride, added as its electrolyte, is the chief component producing ions and its medicated element, which can be added in combination with other pharmaceuticals or replaced by other similar medicine such as sodium hexametaphosphate or Chinese herb medicine like scrutellaria baicalensis. The white sugar, mint and tangerine essences are effective in removing unpleasant odor produced by the above-mentioned components.

What is claimed is:

1. A device for treating oral cavity diseases comprising:

(a) resilient conductive means for contacting the teeth;

(b) an exposed conductor adjacent but not contacting the resilient conductive means for disposition within the oral cavity, (c) means for connecting the negative pole of a battery to the resilient conductive means and the positive pole of a battery to the exposed conductor, (d) the resilient conductive means including a group of trace elements releasing ions into the cavity upon conduction of current between the resilient conductive means and the exposed conductor within the oral cavity.

2. A device as defined in claim 1 in which the resilient conductive means is comprised of conductive bristles retained by a brush head, the exposed conductor also being retained by the device adjacent the brush head a short distance from the conductive.

3. A device as defined in claim 2 in which the conductive bristles are comprised of a composite tungsten-boron fiber material and nylon.

4. A device as defined in claim 2 or 3 in which the conductive bristles are connected to said means for connecting the negative pole of the battery by a conductive binder.

5. A device as defined in claim 2 or 3 in which the conductive bristle are surrounded by non-conductive toothbrush bristles.

6. A device as defined in claim 1, 2 or 3 including toothpaste containing an electrolyte, said toothpaste being located on the resilient conductive means for forming with saliva of the oral cavity a current path between the exposed conductor and the resilient conductive means.

7. A device as defined in claim 1, 2 or 3, in which the trace elements are one or more of the trace elements molybdenum, cobalt, vanadium, beryllium, platinum and rhenium.

8. A device as defined in claim 1, 2 or 3, including a toothpaste containing electrolytes of said resilient conductive means for forming a current path between the exposed conductor and the resilient conductive means, the toothpaste containing sodium fluoride as an electrolyte for producing ions.

9. A device as defined in claim 1, 2 or 3 including a toothpaste containing electrolytes on said resilient conductive means for forming a current path between the exposed conductor and the resilient conductive means, the toothpaste containing sodium hexameta-phosphate as an electrolyte for producing ions.

10. A device as defined in claim 1 including a toothpaste containing electrolytes on said resilient conductive means for forming a current path between the exposed conductor and the resilient conductive means, the toothpaste containing scrutellaria baicalensis as an electrolyte for producing ions.

11. A device as defined in claim 1 including a toothpaste containing electrolytes on said resilient conductive means for contacting teeth for forming a current path between the exposed conductor and the resilient conductive means, the toothpaste containing sodium dodecanol sulphate as a frothe-generator and cleaner, methyl cellulose as an excipient, sodium fluoride as the electrolyte for producing ions and as a medicated element, glycerol as a pain killer, water as a solvent, and further comprising an odor remover, a flavoring essence and an abrasive agent.

12. A device as defined in claim 11 in which the odor remover is comprised of pure white sugar.

13. A toothbrush device for treating oral cavity diseases having a handle and a head comprising:

(a) a cavity in the handle for retaining a battery, (b) a toothbrush bristle retained by the head attached to the handle for cleaning the teeth, (c) a cathode conductor for connection to the negative pole of the battery, (d) an exposed conductive anode adjacent to the brush head for connection to the positive pole of the battery, (e) first conductive bristles retained by the brush head serving as a cathode, said first conductive bristles being comprised of a composite tungsten-boron fiber material and including a group of trace elements capable of releasing ions, the first conductive bristles being connected to the cathode conductor for connection to the negative pole of the battery.

14. A device as claimed in claim 13, in which said first conductive bristles are connected to the cathode conductor with a conductive binder.

15. A device as claimed in claim 13 or 14, in which said first conductive bristles are adherent to the brush head with a conductive binder having a nylon base.

16. A device as claimed in claim 13 further comprising toothpaste containing an electrolyte on the resilient conductive means for forming a circuit with saliva between the anode and the first conductive bristles.

* * * * *